US009804532B2

(12) United States Patent
Goda

(10) Patent No.: US 9,804,532 B2
(45) Date of Patent: Oct. 31, 2017

(54) DEVELOPING DEVICE HAVING PASSAGE OF FLOATING TONER, AND IMAGE FORMING APPARATUS INCLUDING THE SAME

(71) Applicant: KYOCERA Document Solutions Inc., Osaka-shi, Osaka (JP)

(72) Inventor: Mitsuhiro Goda, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/180,697

(22) Filed: Jun. 13, 2016

(65) Prior Publication Data

US 2016/0370754 A1 Dec. 22, 2016

(30) Foreign Application Priority Data

Jun. 17, 2015 (JP) ..... 2015-121861

(51) Int. Cl.
*G03G 15/08* (2006.01)
*G03G 21/20* (2006.01)

(52) U.S. Cl.
CPC ..... *G03G 15/0898* (2013.01); *G03G 21/206* (2013.01)

(58) Field of Classification Search
CPC ..... G03G 15/0898; G03G 21/206; G03G 21/1623
See application file for complete search history.

(56) References Cited

U.S. PATENT DOCUMENTS

2008/0205925 A1* 8/2008 Hatano ..... G03G 15/0898 399/92
2010/0181717 A1* 7/2010 Sumikura ..... G03G 15/6573 271/90
2010/0296834 A1* 11/2010 Omori ..... G03G 15/0898 399/99
2016/0320749 A1* 11/2016 Komatsuzaki ..... G03G 21/206

FOREIGN PATENT DOCUMENTS

JP 11143223 A 5/1999
JP 2004294930 A 10/2004

* cited by examiner

*Primary Examiner* — Francis Gray
(74) *Attorney, Agent, or Firm* — Alleman Hall Creasman & Tuttle LLP

(57) ABSTRACT

A developing device includes a developing roller, a housing, and a film member. A side opening provided in the housing communicates with a suction device at an end in a rotation axis direction of the developing roller. A downstream cover portion of the housing covers the developing roller from a downstream side in a rotation direction of the image carrying member. Concave portions of the downstream cover portion and a portion of a film member bonded to the downstream cover portion form ducts that communicate from openings facing the image carrying member to the side opening.

3 Claims, 5 Drawing Sheets

DEVELOPING DEVICE HAVING PASSAGE OF FLOATING TONER, AND IMAGE FORMING APPARATUS INCLUDING THE SAME

INCORPORATION BY REFERENCE

This application is based upon and claims the benefit of priority from the corresponding Japanese Patent Application No. 2015-121861 filed on Jun. 17, 2015, the entire contents of which are incorporated herein by reference.

BACKGROUND

The present disclosure relates to a developing device and an image forming apparatus.

In an electrophotographic image forming apparatus such as a printer, a copier, a facsimile apparatus, or a multifunction peripheral, toner that has not been attracted to an electrostatic latent image formed on an image carrying member would float in a developing device. If the floating toner leaks to outside of the developing device, the inside of the image forming apparatus may be smeared and the printing quality may be deteriorated.

It is known that, to prevent the floating toner from being scattered outside the developing device, a suction device such as a fan is used to suck the floating toner. For example, a duct having a suction port for sucking the floating toner is provided at a location near a developing roller on the upstream side in a rotation direction of the image carrying member.

SUMMARY

A developing device according to an aspect of the present disclosure includes a developing roller, a housing, and a film member. The developing roller is configured to rotate while facing a rotating photoconductor. The housing is a mold member made of synthetic resin and covers the developing roller. The housing includes a side opening and a downstream cover portion. The side opening is an opening provided at an end of the housing in a rotation axis direction of the developing roller and communicates with a suction device. The downstream cover portion covers the developing roller from a downstream side in a rotation direction of the image carrying member. The downstream cover portion includes a plurality of facing openings and a plurality of concave portions. The plurality of facing openings are openings formed at a plurality of locations along the rotation axis direction of the developing roller in an end surface of the downstream cover portion that faces the image carrying member. The plurality of concave portions are formed along a plurality of paths that extend from the plurality of facing openings to the side opening. The film member is bonded to a surface of the downstream cover portion to overlap the concave portions. The concave portions of the downstream cover portion and a portion of the film member stretched over the concave portions form a plurality of ducts that communicate from the plurality of facing openings to the side opening and are separated from an inner space of the housing.

An image forming apparatus according to another aspect of the present disclosure includes an image carrying member, a suction device configured to suck air, and the developing device according to an aspect of the present disclosure. An electrostatic latent image is formed on a surface of the image carrying member while it is rotating.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the attached drawings. It should be noted that the following embodiment is an example of a specific embodiment of the present disclosure and should not limit the technical scope of the present disclosure.

[Configuration of Image Forming Apparatus 100]

An image forming apparatus 100 is an electrophotographic image forming apparatus.

Figure 1:
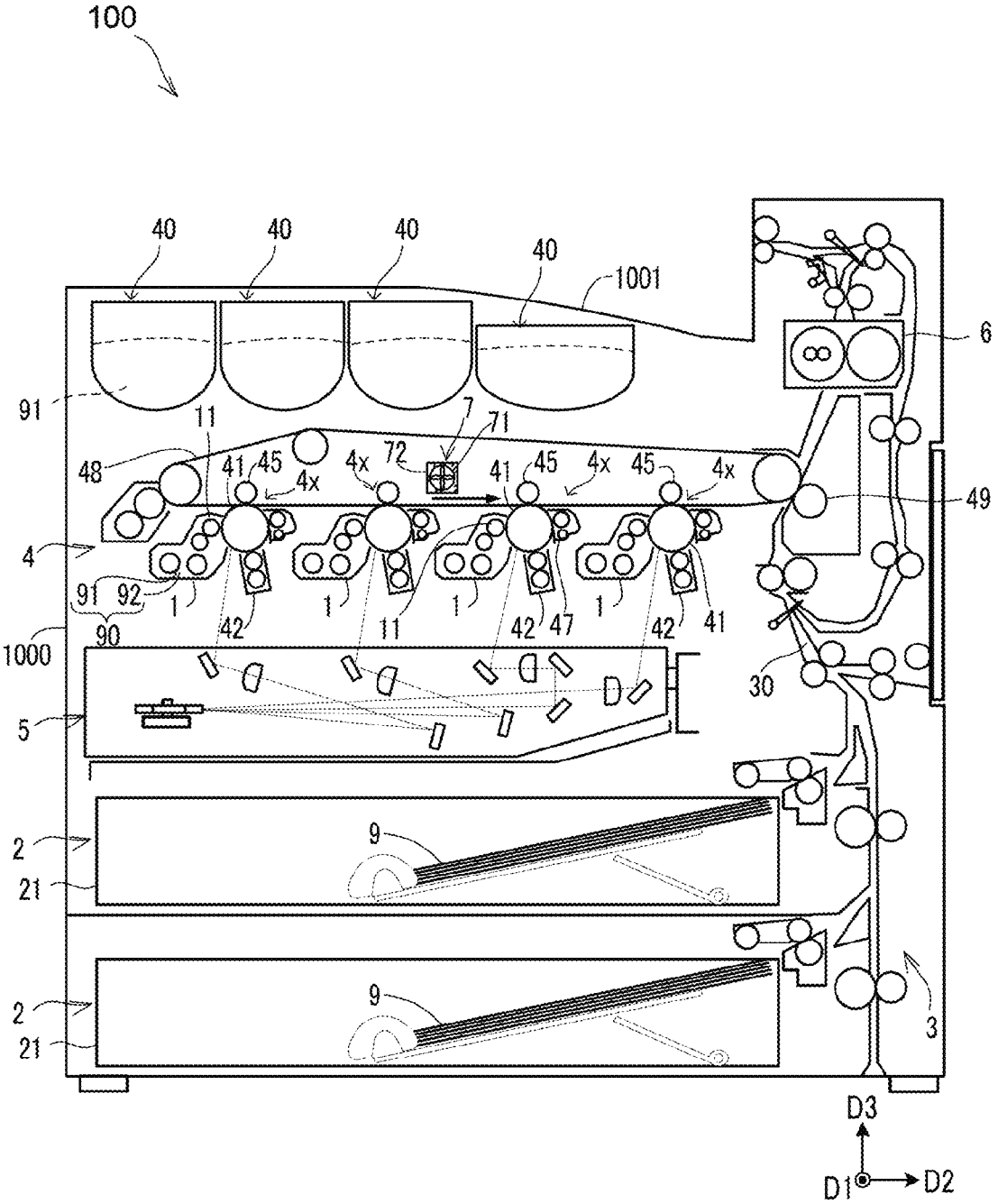
FIG. 1 is a configuration diagram of an image forming apparatus including a developing device according to an embodiment of the present disclosure.

As shown in FIG. 1, the image forming apparatus 100 includes, in a housing 1000, a sheet supply portion 2, a sheet conveying portion 3, toner replenishing portions 40, an image forming portion 4, a laser scanning portion 5, a fixing portion 6, and a suction device 7.

The image forming apparatus 100 shown in FIG. 1 is a tandem image forming apparatus, and is a color printer. As a result, the image forming portion 4 includes an intermediate transfer belt 48 and a secondary transfer device 49.

In addition, the image forming portion 4 includes a plurality of single-color image forming portions 4*x* that respectively correspond to the colors of cyan, magenta, yellow and black. Furthermore, a plurality of toner supply portions 40 supply toner 91 of the colors cyan, magenta, yellow and black respectively to a plurality of developing devices 1.

It is noted that the image forming apparatus 100 is, for example, a printer, a copier, a facsimile apparatus, or a multifunction peripheral. The multifunction peripheral has a plurality of functions such as functions of a printer and a copier.

The sheet supply portion 2 is configured to feed a sheet member 9 from a sheet receiving portion 21 toward a conveyance path 30. The sheet conveying portion 3 conveys the sheet member 9 supplied from the sheet supply portion 2 toward the secondary transfer device 49 of the image forming portion 4, and further discharges the sheet member 9 onto a discharge tray 1001.

The intermediate transfer belt 48 is an endless belt-like member formed in an annular shape. The intermediate transfer belt 48 is rotated in the state of being suspended between two rollers. The single-color image forming portions 4*x* form images of respective colors on the surface of the rotating intermediate transfer belt 48. With this operation, the images of different colors are overlaid and a color image is formed on the intermediate transfer belt 48.

The secondary transfer device 49 transfers the toner image formed on the intermediate transfer belt 48 to the sheet member 9.

Each of the single-color image forming portions 4*x* includes a drum-like photoconductor 41 that carries the toner image, a charging device 42, a developing device 1, and a primary transfer device 45. The charging device 42, the developing device 1, the primary transfer device 45, and a primary cleaning device 47 are disposed to face the photoconductor drum 41 from different directions respectively. It is noted that the photoconductor 41 is an example of the image-carrying member on whose surface an electrostatic latent image is formed while it is rotating.

In each of the single-color image forming portions 4*x*, the photoconductor 41 rotates and the charging device 42 uniformly charges the surface of the photoconductor drum 41. Furthermore, the laser scanning portion 5 writes an electrostatic latent image on the charged surface of the photoconductor 41 by scanning a laser beam thereon. The developing device 1 develops the electrostatic latent image on the photoconductor 41 by supplying the toner 91 to the photoconductor 41.

The developing device 1 charges the toner 91 by stirring two-component developer 90 that includes the toner 91 and carrier 92, and supplies the charged toner 91 to the photoconductor 41. This allows the electrostatic latent image formed on the surface of the photoconductor 41 to be visualized as the toner image.

The carrier 92 is a granular material having magnetism. The carrier 92 may be, for example, a granular material including magnetic body particles which are each coated with a film of synthetic resin such as epoxy resin.

The primary transfer devices 45 transfer the toner images on the surfaces of the photoconductors 41 to the intermediate transfer belt 48. A plurality of images of the toner 91 are respectively transferred from the plurality of photoconductors 41 to the intermediate transfer belt 48.

The secondary transfer device 49 transfers the toner images on the surface of the intermediate transfer belt 48 to the sheet member 9 that is moving in the conveyance path 30.

The fixing portion 6 is a device that fixes the toner image to the sheet member 9 by applying heat thereto.

The suction device 7 is a device for sucking air. The suction device 7 forms flows of air so that floating toner in the developing devices 1 can be sucked before it is scattered outside the developing devices 1. The suction device 7 prevents the floating toner from being scattered outside the developing devices 1.

Figure 3:
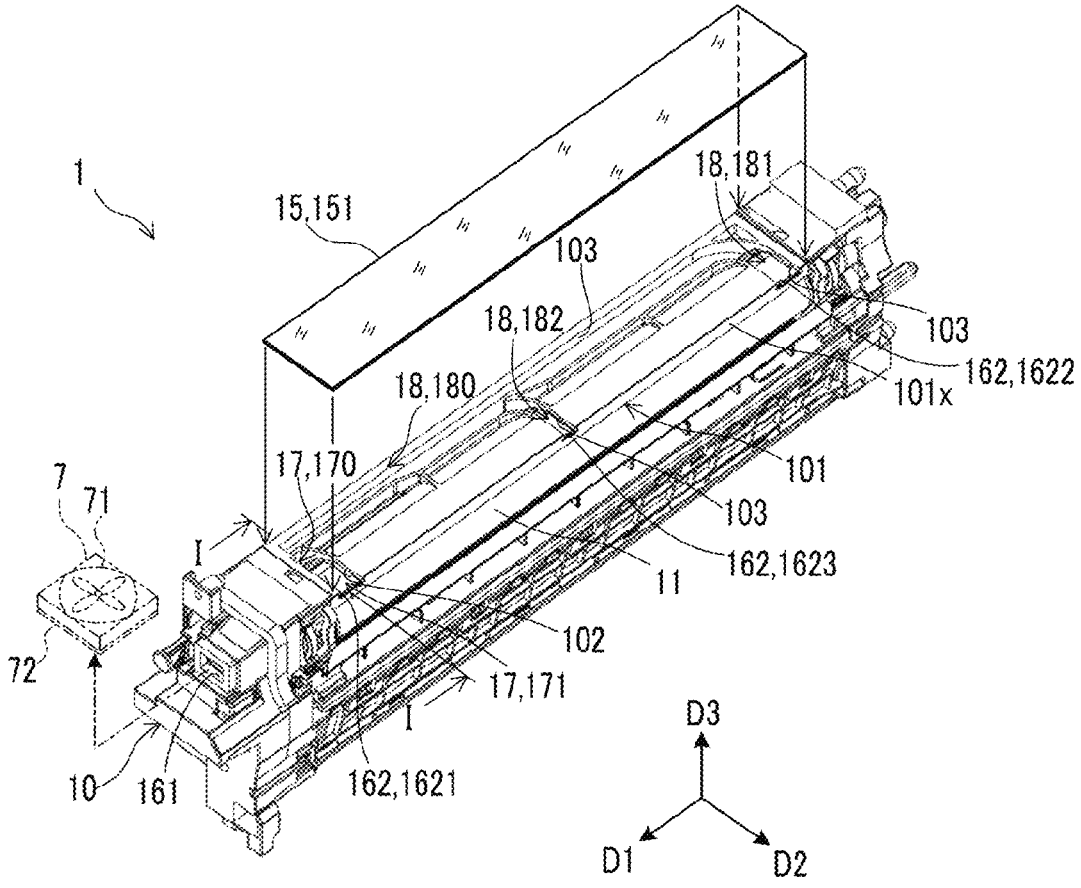
FIG. 3 is a partially disassembled perspective view of the developing device according to an embodiment of the present disclosure.

As one example, the suction device 7 is provided with an air blower 71 to suck air from ducts that are included in the developing devices 1 (see FIG. 3). Furthermore, the suction device 7 includes a filter 72. The filter 72 traps the floating toner that is sucked together with air. The suction device 7 is shared by the plurality of developing devices 1.

[Configuration of Developing Device 1]

Figure 2:
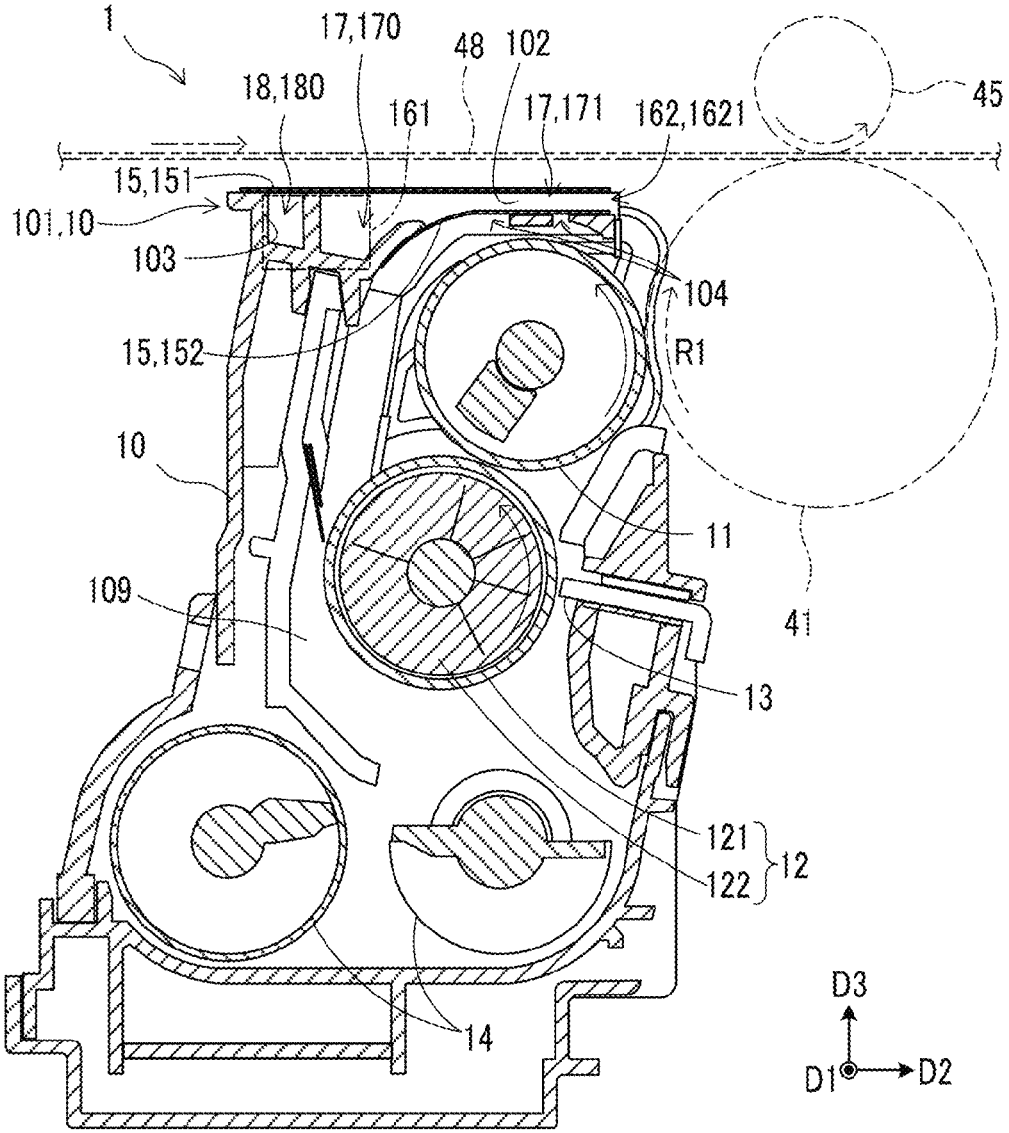
FIG. 2 is a longitudinal sectional view of the developing device according to an embodiment of the present disclosure.

As shown in FIG. 2, each developing device 1 includes a housing 10, a developing roller 11, a rotating sleeve 121, magnets 122, a blade 13, and a stirring mechanism 14. The rotating sleeve 121 contains the magnets 122, and the magnets 122 and the rotating sleeve 121 constitute a magnetic roller 12. The rotating sleeve 121 is a non-magnetic body.

The housing 10 is a container storing the two-component developer 90. The developing roller 11 and the rotating sleeve 121 are rotatably supported. The housing 10 covers the developing roller 11 from directions other than a direction in which the developing roller 11 faces the photoconductor 41. The rotating sleeve 121 and the stirring mechanism 14 are provided in the housing 10.

The stirring mechanism 14 stirs the two-component developer 90 by rotating in the housing 10. The toner 91 is charged by being stirred.

The rotating sleeve 121 is a rotor that rotates while carrying the stirred two-component developer 90. The rotating sleeve 121 rotates while carrying the two-component developer 90. During this operation, the two-component developer 90 is held by the rotating sleeve 121 at a lower position, conveyed by the rotating sleeve 121 while it is rotating, passes a position to face the developing roller 11, and is conveyed up to a further downstream position.

The rotating sleeve 121 supplies the toner 91 to the developing roller by rotating while carrying the two-component developer 90 on its circumferential surface. The rotating sleeve 121 is an example of the developer carrying member.

The developing roller 11 rotates while facing the rotating photoconductor 41. The developing roller 11 rotates while carrying the toner 91 supplied from the rotating sleeve 121 on its circumferential surface. The developing roller 11 develops the electrostatic latent image formed on the photoconductor 41, with the toner 91 which it carries on its circumferential surface while rotating. The developing roller 11 is an example of the toner carrying member.

The developing roller 11 rotates in a direction reverse to the rotation direction of the photoconductor 41. In addition, the rotating sleeve 121 rotates in the same direction as the developing roller 11. Hereinafter, the rotation direction of the photoconductor 41 is referred to as a photoconductor rotation direction R1.

The rotating sleeve 121 contains a plurality of magnets 122 and attracts and holds carrier 92 by the magnetism of the magnets 122, and carries the carrier 92 while rotating, from the lower position until passing the position of facing the developing roller 11. This allows the rotating sleeve 121 to carry the carrier 92 and the toner 91 that is adhered to the carrier 92, while rotating. The blade 13 restricts the layer thickness of the two-component developer 90 carried by the rotating sleeve 121.

A plurality of particles of carrier 92 that are attracted to the rotating sleeve 121, form a magnetic brush which consists of lines of the particles of carrier 92 erected from the outer circumferential surface of the rotating sleeve 121 by the action of the magnetic field of the magnets 122. The magnetic brush contacts the outer circumferential surface of the developing roller 11.

By the action of a bias voltage applied to between the developing roller 11 and the rotating sleeve 121, the toner 91 adhered to the magnetic brush moves to the developing roller 11. Furthermore, due to the potential difference between the developing roller 11 and the electrostatic latent image on the photoconductor 41, the toner 91 flies from the developing roller 11 to the electrostatic latent image.

The developing device 1 including the magnetic roller 12 and the developing roller 11 develops the electrostatic latent image on the surface of the photoconductor 41 by the so-called interactive touchdown method.

Meanwhile, the toner floating in each developing device 1 tends to move in an air flow that is generated by the rotation of the photoconductor 41. As a result, the floating toner tends to leak to outside of the developing device 1 from the downstream side in the photoconductor rotation direction R1.

In addition, if the floating toner is sucked from an opening that communicates with an inner space of the developing device 1, it might adversely affect the transition of the toner 91 from the developing roller 11 to the photoconductor 41 and lead to deterioration of image quality.

It is thus preferable to suck the floating toner from the downstream side in the photoconductor rotation direction R1.

However, in each developing device 1 of the image forming apparatus 100, the space on the downstream side in the photoconductor rotation direction R1 is narrow. As a result, it is required to suck the floating toner from the downstream side in the photoconductor rotation direction R1 even if the space on the downstream side in the photoconductor rotation direction R1 is narrow.

The developing device 1 includes ducts 17 and 18 that are configured to suck the floating toner from the downstream side in the photoconductor rotation direction R1 even if the space on the downstream side in the photoconductor rotation direction R1 is narrow.

[Configuration of Ducts 17 and 18]

In the following, the configuration of the ducts 17 and 18 for sucking the floating toner is described with reference to FIG. 2 to FIG. 5. FIG. 2 is a cross section taken along a plane I-I shown in FIG. 3.

The developing device 1 includes a film member 15 bonded to the housing 10. A part of the housing 10 and the film member 15 form the ducts 17 and 18 for sucking the floating toner that leaks from the inside of the developing device 1.

The housing 10 of the developing device 1 is a mold member made of synthetic resin and covers the developing roller 11. That is, the housing 10 is a member formed by an injection molding. For example, the housing 10 is a mold member made of thermoplastic resin that is composed mainly of polypropylene, polyethylene, polyvinyl chloride, polybutylene terephthalate, or polyamide.

In the following description, the rotation axis direction of the developing roller 11, namely, a direction that extends along the rotation center of the developing roller 11 is referred to as a first direction D1. In addition, a direction that is perpendicular to the first direction D1 is referred to as a second direction D2. A third direction D3 shown in the drawings is a direction that is perpendiculart to the first direction D1 and the second direction D2.

The housing 10 includes a side opening 161 and a downstream cover portion 101. As shown in FIG. 3, the side opening 161 is an opening that is provided at an end of the housing 10 in the first direction D1 and communicates with the suction device 7. The side opening 161 and the suction device 7 are located close to an end of the developing devices 1 in the first direction D1.

The downstream cover portion 101 is a portion of the housing 10 covering the developing roller 11 from the downstream side in the photoconductor rotation direction R1. In the present embodiment, the housing 10 has a configuration where a plurality of members including the downstream cover portion 101 are solidly combined to each other.

FIG. 3 shows the housing 10 in the state where a plurality of members including the downstream cover portion 101 are solidly combined to each other. In FIG. 3, the film member 15 is in the state of being removed from the housing 10.

Figure 4:
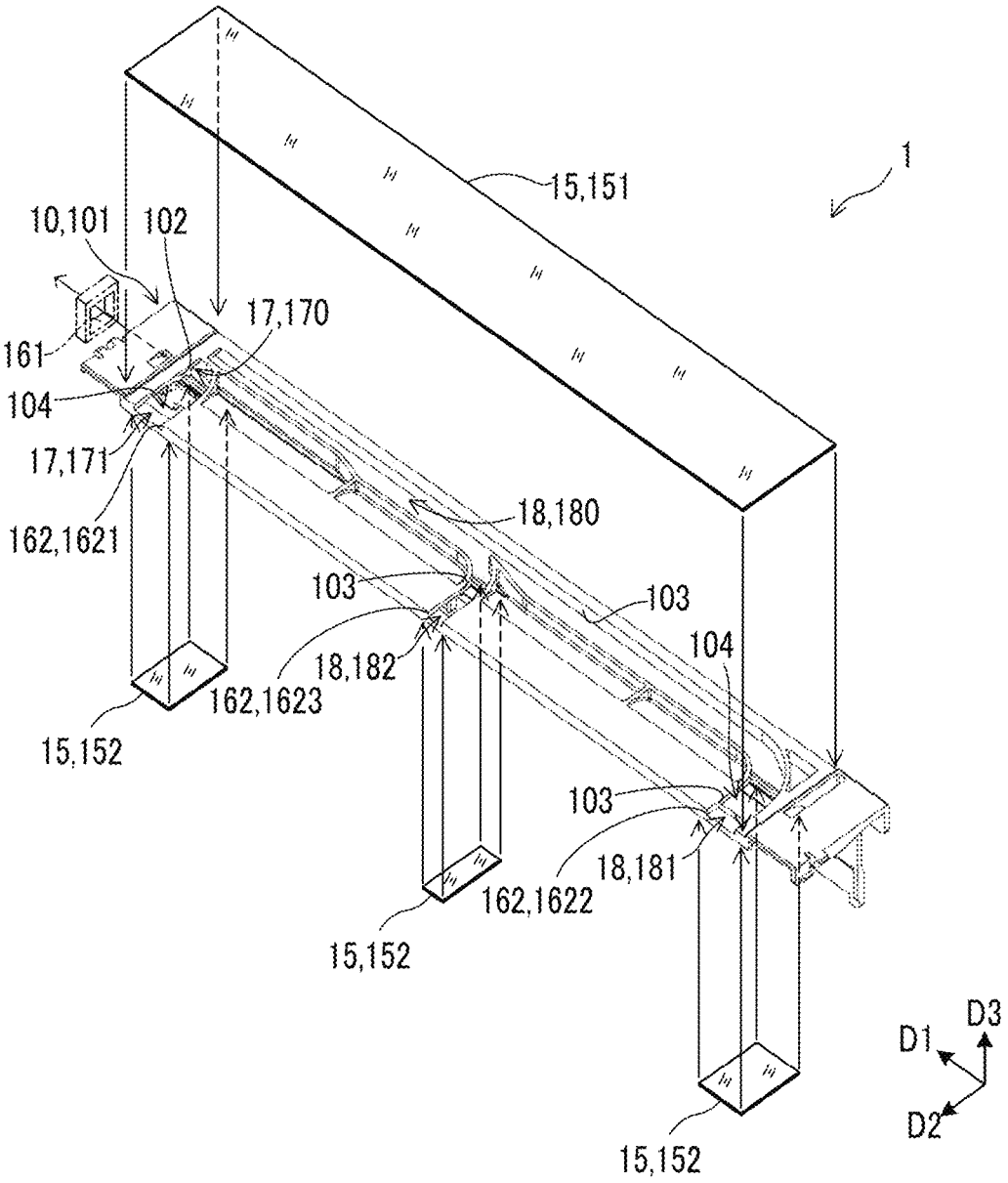
FIG. 4 is a perspective view of a downstream cover portion and a film member viewed from an outside of the downstream cover portion in the developing device according to an embodiment of the present disclosure.
Figure 5:
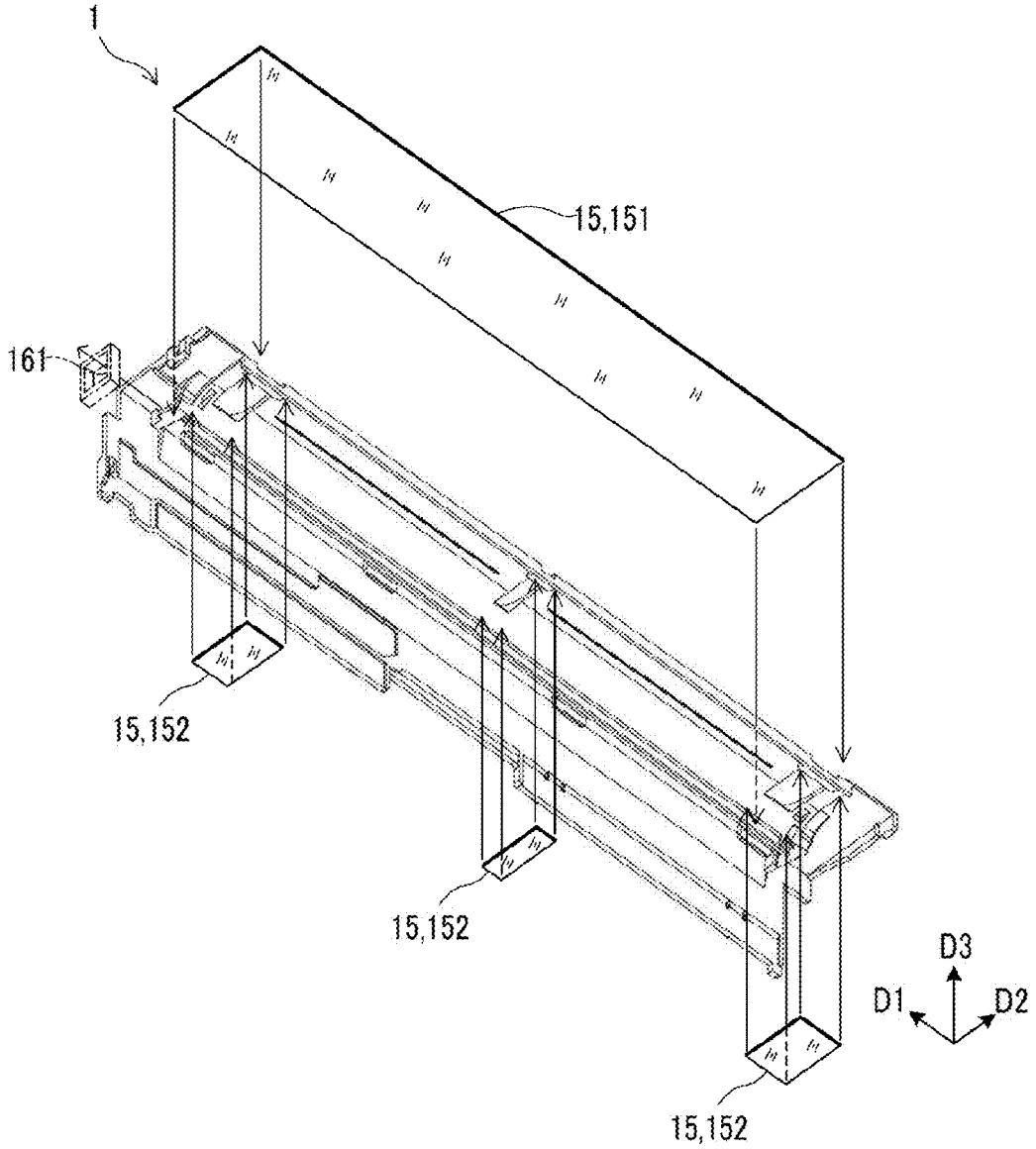
FIG. 5 is a perspective view of the downstream cover portion and the film member viewed from an inside of the downstream cover portion in the developing device according to an embodiment of the present disclosure.

FIG. 4 and FIG. 5 show the downstream cover portion 101 removed from the other members of the housing 10. FIG. 4 is a perspective view of the downstream cover portion 101 viewed from outside of the developing device 1. FIG. 5 is a perspective view of the downstream cover portion 101 viewed from inside of the developing device 1.

In the developing device 1, the film member 15 is bonded to a surface of the downstream cover portion 101. As one example, the film member 15 is made of synthetic resin such as PET (polyethylene terephthalate), vinyl chloride, or polycarbonate.

In general, the film member 15 formed from a PET film or the like has a small variation in thickness and a high mechanical strength even when it is from approximately several tens micrometers to 250 micrometers thick. On the other hand, it is difficult to mold, with high dimensional accuracy, a part of the mold member to be as thin as the PET film.

As shown in FIG. 3 and FIG. 4, the downstream cover portion 101 includes a plurality of facing openings 162 and concave portions 102 and 103.

The plurality of facing openings 162 are formed at a plurality of locations along the first direction D1 in an end surface of the downstream cover portion 101 that faces the photoconductor 41, namely, in a surface at an end in the second direction D2 of the downstream cover portion 101.

The concave portions 102 and 103 are concaves formed along a plurality of paths that extend from the plurality of facing openings 162 to the side opening 161.

Figure 6:
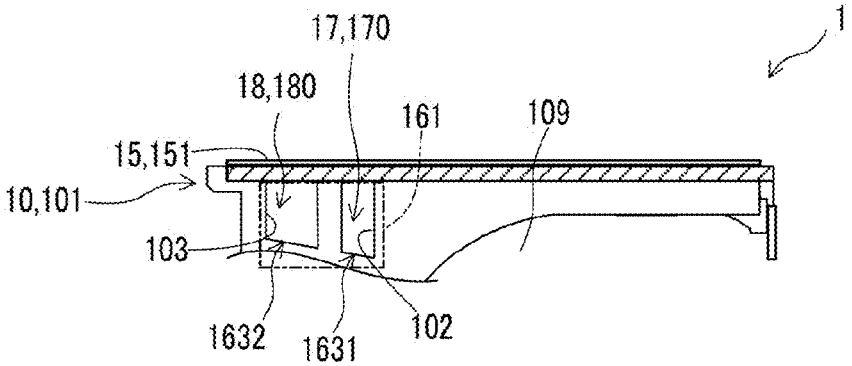
FIG. 6 is a longitudinal sectional view of an end portion of the downstream cover portion in the developing device according to an embodiment of the present disclosure.

As shown in FIG. 6, the downstream cover portion 101 has side vent holes 1631 and 1632 at an end on the side opening 161 side in the first direction D1. The side vent holes 1631 and 1632 are openings that communicate with: ends of the concave portions 102 and 103 on the side opening 161 side in the first direction D1; and the side opening 161. The concave portions 102 and 103 are groove-like concaves extending from the plurality of facing openings 162 to the side vent holes 1631 and 1632.

In other words, openings of the concave portions 102 and 103 at an end on the photoconductor 41 side in the second direction D2 are the facing openings 162. In addition, openings of the concave portions 102 and 103 at an end on the side opening 161 side in the first direction D1 are the side vent holes 1631 and 1632.

The film member 15 is bonded to the surface of the downstream cover portion 101 to overlap the concave portions 102 and 103. As one example, the film member 15 is bonded to the surface of the downstream cover portion 101 by adhesive that is formed on the surface in advance.

As shown in FIG. 2, the concave portions 102 and 103 of the downstream cover portion 101 and a portion of the film member 15 stretched over the concave portions 102 and 103 form ducts 17 and 18. The ducts 17 and 18 communicate from the plurality of facing openings 162 to the side opening 161. In addition, the ducts 17 and 18 are separated from an inner space 109 of the housing 10.

In the present embodiment, the concave portions 102 and 103 of the downstream cover portion 101 have inner openings 104 that communicate with the inner space 109 of the housing 10. In this case, the film member 15 includes an outer film member 151 and inner film members 152.

The outer film member 151 closes outer openings of the concave portions 102 and 103 of the downstream cover portion 101. On the other hand, the inner film members 152 close inner openings of the concave portions 102 and 103 of the downstream cover portion 101.

As a result, in a part of the ducts 17 and 18, the outer film member 151 and bottom surfaces of the concave portions 102 and 103 of the downstream cover portion 101 form partition walls in the inward and outward directions. In addition, in the other part of the ducts 17 and 18, the outer film member 151 and the inner film members 152 form partition walls in the inward and outward directions.

That is, the outer film member 151 bonded to the downstream cover portion 101 forms an outer partition wall in the inward and outward directions of the downstream cover portion 101. This makes it possible to make the ducts 17 and 18 extremely thin in the inward and outward directions.

As shown in FIG. 4, in the present embodiment, the plurality of facing openings 162 include a first facing opening 1621 and a second facing opening 1622. The first facing opening 1621 is a facing opening 162 included in the downstream cover portion 101 at an end thereof close to the side opening 161 in the first direction D1. The second facing opening 1622 is a facing opening 162 included in the downstream cover portion 101 at an end thereof opposite to the side opening 161 in the first direction D1.

Furthermore, in the present embodiment, the plurality of facing openings 162 include a third facing opening 1623. The third facing opening 1623 is a facing opening 162 formed in the end surface of the downstream cover portion 101 facing the photoconductor 41, at a location between the first facing opening 1621 and the second facing opening 1622.

It is noted that in the example shown in FIG. 3 and FIG. 4, one third facing opening 1623 is provided. However, a plurality of third facing openings 1623 may be formed between the first facing opening 1621 and the second facing opening 1622.

In addition, in the present embodiment, the ducts 17 and 18 are a first duct 17 and a second duct 18 that are separated from each other.

As shown in FIG. 4, the first duct 17 is formed so as to communicate from the first facing opening 1621 to the side opening 161. The first facing opening 1621 is a suction port for the first duct 17.

The second duct 18 is formed so as to communicate from the second facing opening 1622 to the side opening 161. In the present embodiment, the second duct 18 is also formed so as to communicate from the third facing opening 1623 to the side opening 161. The second facing opening 1622 and the third facing opening 1623 are suction ports for the second duct 18.

In a gap between the developing device 1 and the photoconductor 41, an air flow is likely to be generated flowing from the centeral region to opposite ends in the first direction D1. As a result, the floating toner is likely to leak to outside of the housing 10 at near the opposite ends of the developing device 1 in the first direction D1.

Thus, the first facing opening 1621 and the second facing opening 1622 provided as suction ports allow the floating toner that leaks from the housing 10 to be sucked efficiently.

In general, when the suction device 7 is located close to a side end of the developing device 1, the farther a suction port is from the suction device 7, the weaker the force of the suction port sucking the floating toner is. As a result, it is difficult to balance among different positions along the first direction D1 with regard to the force of sucking the floating toner.

On the other hand, in the present embodiment, the first duct 17 forms a passage that is at least partially smaller in cross sectional area than a passage of the second duct 18. As one example, as shown in FIG. 6, a first side vent hole 1631 that is an opening at an end of the first duct 17 is smaller in cross sectional area than a second side vent hole 1632 that is an opening at an end of the second duct 18.

According to the present embodiment, the first duct 17 and the second duct 18 are formed independently, and passages thereof are different from each other in cross sectional area. This makes it possible to appropriately balance among different positions along the first direction D1 with regard to the force of sucking the floating toner.

In addition, in the present embodiment, the second duct 18 includes a main flow duct 180, a first branch duct 181, and a second branch duct 182. The main flow duct 180 is formed along the first direction D1, and communicates with the side opening 161.

The first branch duct 181 communicates with the second facing opening 1622 and the main flow duct 180. The second branch duct 182 communicates with the third facing opening 1623 and the main flow duct 180.

The second branch duct 182 forms a passage that is at least partially smaller in cross sectional area than a passage of the first branch duct 181. In the present embodiment, the whole second branch duct 182 that extends from the third facing opening 1623 to the main flow duct 180 is smaller in cross sectional area of passage than the whole first branch duct 181 that extends from the second facing opening 1622 to the main flow duct 180.

According to the present embodiment, a plurality of branch ducts 181 and 182 that merge with one main flow duct 180 are different from each other in cross sectional area of passage. This makes it possible to appropriately balance among different positions along the first direction D1 with regard to the force of sucking the floating toner.

As shown in FIG. 2, the main flow duct 180 is positioned at an opposite side of the photoconductor 41 to the developing roller 11. In addition, the main flow duct 180 has a more depth extending toward the inner space 109 of the housing 10 than the first branch duct 181 and the second branch duct 182. With this configuration, the passage of the main flow duct 180 does not project toward the downstream in the photoconductor rotation direction R1, and is larger in cross sectional area than the passage of the first branch duct 181 or the second branch duct 182.

It is noted that as is the case with the second duct 18, the first duct 17 includes a main flow duct 170 and a branch duct 171. The main flow duct 170 is formed along the first direction D1, and communicates with the side opening 161. The branch duct 171 communicates with the first facing opening 1621 and the main flow duct 170. However, the first duct 17 does not have a configuration where a plurality of branch parts merge with one main flow part.

In the image forming apparatus 100 described above, the suction device 7 is located close to a side end in the first direction D1 of the developing device 1

Furthermore, in the developing device 1, the ducts 17 and 18 that communicate with the plurality of facing openings 162 and the side opening 161 and are separated from the inner space 109 of the housing 10, are integrally formed with the downstream cover portion 101.

As a result, the space occupied by the mechanism for sucking the floating toner on the downstream side in the photoconductor rotation direction R1 is extremely small.

Furthermore, the ducts 17 and 18 are composed of an extremely thin film member 15 and the concave portions 102 and 103 formed in the downstream cover portion 101. This allows the space occupied by the ducts 17 and 18 on the downstream side in the photoconductor rotation direction R1 to be further small.

In addition, in the present embodiment, the image forming apparatus 100 is a tandem image forming apparatus including the plurality of developing devices 1 and the plurality of photoconductors 41 that correspond thereto, and the intermediate transfer belt 48.

In the tandem image forming apparatus, the developing devices 1 are disposed at very narrow intervals with respect to the intermediate transfer belt 48 that is located on the downstream side in the photoconductor rotation direction R1. In such a tandem image forming apparatus, the effect of making the space occupied by the ducts 17 and 18 small is prominent.

More specifically, as shown in FIG. 2, in each developing device 1, the outer surface of the downstream cover portion 101 is formed along the intermediate transfer belt 48. Accordingly, in each developing device 1, the outer film member 151 bonded to the outer surface of the downstream cover portion 101 is formed along the intermediate transfer belt 48. With this configuration, the space on the downstream side in the photoconductor rotation direction R1 of each developing device 1 is used effectively as the ducts 17 and 18 without any waste.

[Application Examples]

In the developing device 1 described above, the concave portions 102 and 103 of the downstream cover portion 101 may not have the inner openings 104 that communicate with the inner space 109 of the housing 10. In this case, the inner film members 152 are not necessary.

In addition, the ducts 17 and 18 of the developing device 1 may be applied to a developing device of the two-component developing system. In the developing device of the two-component developing system, the magnetic roller 12 functions as a developing roller.

It is noted that the developing device and the image forming apparatus of the present disclosure may be configured by freely combining, within the scope of claims, the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a developing roller configured to rotate while facing a rotating photoconductor;

a housing that is a mold member made of synthetic resin and covers the developing roller; and a film member, wherein the housing includes:

a side opening that is an opening provided at an end of the housing in a rotation axis direction of the developing roller and communicates with a suction device; and a downstream cover portion covering the developing roller from a downstream side in a rotation direction of the image carrying member, the downstream cover portion includes:

a plurality of facing openings that are openings formed at a plurality of locations along the rotation axis direction of the developing roller in an end surface of the downstream cover portion that faces the image carrying member; and a plurality of concave portions formed along a plurality of paths that extend from the plurality of facing openings to the side opening, the film member is bonded to a surface of the downstream cover portion to overlap the concave portions, the concave portions of the downstream cover portion and a portion of the film member stretched over the concave portions form a plurality of ducts that communicate from the plurality of facing openings to the side opening and are separated from an inner space of the housing, the ducts include a first duct and a second duct that are separated from each other, the first duct is formed so as to communicate from a first facing opening to the side opening, the first facing opening being one of the plurality of facing openings included in the downstream cover portion at an end thereof close to the side opening in the rotation axis direction of the developing roller, the second duct is formed so as to communicate from a second facing opening to the side opening, the second facing opening being one of the plurality of facing openings included in the downstream cover portion at an end thereof opposite to the side opening in the rotation axis direction of the developing roller, and the first duct forms a passage that is at least partially smaller in cross sectional area than a passage of the second duct.

2. The developing device according to claim 1, wherein the second duct includes:

a main flow duct that is formed along the rotation axis direction of the developing roller and communicates with the side opening;

a first branch duct that communicates with the second facing opening and the main flow duct; and one or more second branch ducts that communicate with one or more third facing openings and the main flow duct, the one or more third facing openings are formed between the first facing opening and the second facing opening in the end surface of the downstream cover portion that faces the image carrying member, and the second branch duct forms a passage that is at least partially smaller in cross sectional area than a passage of the first branch duct.

3. An image forming apparatus comprising:

an image carrying member on whose surface an electrostatic latent image is formed while rotating;

a suction device configured to suck air; and a plurality of developing devices, each developing device comprising:

a developing roller configured to rotate while facing a rotating photoconductor;

a housing that is a mold member made of synthetic resin and covers the developing roller; and a film member, wherein the housing includes:

a side opening that is an opening provided at an end of the housing in a rotation axis direction of the developing roller and communicates with a suction device; and a downstream cover portion covering the developing roller from a downstream side in a rotation direction of the image carrying member, the downstream cover portion includes:

a plurality of facing openings that are openings formed at a plurality of locations along the rotation axis direction of the developing roller in an end surface of the downstream cover portion that faces the image carrying member; and a plurality of concave portions formed along a plurality of paths that extend from the plurality of facing openings to the side opening, the film member is bonded to a surface of the downstream cover portion to overlap the concave portions, and the concave portions of the downstream cover portion and a portion of the film member stretched over the concave portions form a plurality of ducts that communicate from the plurality of facing openings to the side opening and are separated from an inner space of the housing;

a plurality of image carrying members that respectively correspond to the plurality of developing devices; and an intermediate transfer belt to which toner images are transferred from the plurality of image carrying members, wherein in each of the plurality of developing devices, the film member bonded to an outer surface of the downstream cover portion is formed along the intermediate transfer belt.

* * * * *